US005320445A

United States Patent [19]

Farrelly

[11] Patent Number: 5,320,445

[45] Date of Patent: Jun. 14, 1994

[54] GRATE RISER ASSEMBLY FOR USE WITH CATCH BASINS AND THE LIKE

[75] Inventor: Robert E. Farrelly, Windsor, Conn.

[73] Assignee: The Jack Farrelly Co., Bloomfield, Conn.

[21] Appl. No.: 798,864

[22] Filed: Nov. 22, 1991

Related U.S. Application Data

[63] Continuation of Ser. No. 605,577, Oct. 30, 1990, abandoned.

[51] Int. Cl.[5] ..... E01C 11/22; E02D 29/14

[52] U.S. Cl. ..... 404/3; 404/26

[58] Field of Search ..... 92/85 B; 404/2, 3, 26

[56] References Cited

U.S. PATENT DOCUMENTS

| | | | |
|---|---|---|---|
| 4,121,390 | 10/1978 | Hall et al. | 404/26 X |
| 4,544,302 | 10/1985 | Farrelly | 404/26 |
| 4,593,714 | 6/1986 | Madded | 404/26 X |
| 4,909,660 | 3/1990 | Ferns | 404/2 |
| 4,955,752 | 9/1990 | Ferns | 404/2 |
| 4,968,170 | 11/1990 | Wilson et al. | 404/2 |

FOREIGN PATENT DOCUMENTS

| | | | |
|---|---|---|---|
| 2356484 | 11/1973 | Fed. Rep. of Germany | 404/26 |

*Primary Examiner*—Kenneth J. Dorner
*Assistant Examiner*—Nancy Mulcare
*Attorney, Agent, or Firm*—McCormick, Paulding & Huber

[57] ABSTRACT

An improved grate riser assembly for use with catch basins and the like comprising vertically open rectangular frames with two opposing frame sections carrying inwardly projecting horizontally grate support flanges. Cooperating grates have opposite end portions of parallel spaced apart grate members resting on the flanges. The grate riser assembly includes two or more grate risers having vertically open generally rectangular frames coextensive with a catch basin frame and with opposing vertical side and end wall sections of a height substantially equal to the depth of pavement overlay. The frame rests atop a catch basin frame with its top edge substantially level with the top surface of the pavement overlay. At least two horizontally spaced connectors depend from each of two opposing grate riser frame sections to support a pair of elevated horizontal grate support members. The connectors on one frame section are spaced widely apart and on the other frame section narrowly apart. The grate support members have notches therein for receiving vertically the connectors associated with the opposite support member. The second grate riser is rotated through 180° so that the notches thereon receive the connectors of the grate riser therebeneath. The grate is disposed within the second grate riser so as to accommodate a second pavement overlay.

8 Claims, 1 Drawing Sheet

GRATE RISER ASSEMBLY FOR USE WITH CATCH BASINS AND THE LIKE

This is a continuation of application Ser. No. 605,577 filed on Oct. 30, 1990, now abandoned.

BACKGROUND OF THE INVENTION

This invention relates to grate risers for catch basins of the type shown and described in my U.S. Pat. No. 4,544,302 entitled CATCH BASIN GRATE RISER.

Conventional catch basins are formed with generally rectangular frames having at least two similar opposing frame sections each of which carries an inwardly projecting horizontally support flange. The grates associated With the frames include a plurality of parallel spaced apart elongated grate members which are adapted to rest at opposite end portions on the aforementioned frame flanges. The grates are conventionally held in position within the frame by gravity.

When an associated road surface is repaved, there are three conventional techniques employed in raising catch basins to the level of the top surface of the new pavement or overlay.

The first of the conventional techniques requires the aforementioned parts of the catch basin to be removed together with a precast concrete supporting member which is usually associated therewith. Bricks or the like may then be employed to support the precast concrete member at the desired elevated position whereupon the concrete member, the catch basin frame, and the grate are repositioned With the bricks therebeneath.

A second technique or method involves the welding of sections of angle iron or the like to the opposite end portions of the grate at lower portions thereof. This results in the grate being elevated to the desired level while the frame remains in its original position. At its end portions the grate is of course exposed to paving material which may find its way between the grate members and this of course creates a detrimental condition.

A third method involves the welding of a new frame to the top of the existing frame of the catch basin. This of course accommodates only the raising of the catch basin elements an increment equal to the height of the original frame and grate. Thus, if a conventional 3½ inch frame and grate are employed, the elevation thereof can only be 3½ inches. The paving on the other hand may have a desired thickness of only 1½ inches.

As will be apparent, each of the foregoing techniques or methods involves an inefficient and time consuming operation. The removal and replacement of all or part of a catch basin of course requires a substantial expenditure in time. A resulting delay in the paving operation occurs and it is also necessary to employ heavy equipment when the concrete member is removed. At a minimum, and in the practice of each of the foregoing methods, operations such as welding or brick laying are involved. This may require considerable time and expense and even a possible transfer of parts to a welding shop etc.

The grate riser of the aforementioned patent may be installed in a highly efficient and rapid operation and there is no interference Whatsoever With the associated road paving operation. The grate is merely removed from the catch basin, the grate riser is deposited within the frame of the catch basin and the grate is then returned to its initial position except for the elevation thereof by the grate riser. That is, the grate is maintained precisely in a desired position horizontally but is elevated by the grate riser to the exact height required by the thickness of the new pavement.

As will be apparent, the patented grate riser is a highly efficient tool in a repaving operation and has found wide acceptance. There is, however, one major problem which arises in the use of the grate riser. Only a single repavement or pavement overlay can be accomplished.

It is the general object of the present invention to provide an improved grate riser assembly wherein two or more grate risers can be stacked atop one another to accommodate two or more repaving operations or pavement overlays.

SUMMARY OF THE INVENTION

In fulfillment of the aforementioned general object and in accordance with the present invention, an improved grate riser assembly is provided for use with catch basins or the like comprising vertically open generally rectangular frames with at least two opposing frame sections having inwardly projecting horizontal grate support flanges. Grates which cooperate with the frames have opposite end portions with parallel spaced apart elongated horizontal grate members adapted to rest on the frame flanges. The grate is thus held in position within the frame by the force of gravity.

The improved grate riser assembly of the present invention may be disposed in a catch basin frame on removal of the grate from the frame and serve to elevate the grate a desired distance so that its top surface is in coplanar relationship with the top surface of multiple pavement overlays. The assembly comprises a first grate riser having a vertically open generally rectangular frame coextensive with an associated catch basin frame and which includes opposing side and end wall sections of a height substantially equal to the depth of a single pavement overlay to be accommodated thereby. At least two horizontally spaced apart connectors are secured to and depend from each of two opposing grate riser frame sections. Preferably the connectors are secured to and depend from the opposing end sections of the frame and the sections are so chosen as to correspond to the frame sections of the catch basin which carry the supporting flanges for the grate. Conventionally, end sections of the catch basin frame include the grate supporting flanges. The vertical dimension of the connectors is such that the combined vertical dimension thereof and the grate riser frame substantially equals the height of the catch basin grate to be accommodated thereby.

The grate riser also includes a pair of elevated horizontal grate support members associated respectively with said two opposite grate riser frame sections and secured to the connectors at lower end portions of the latter. At least one riser portion is provided on the grate riser support members and depends therefrom so as to be supported atop the grate support flanges on the catch basin frame. With the riser portions so supported and with the vertical dimension of the same and the supporting members substantial equal to the height of the grate riser frame, the frame is disposed as desired atop the catch basin frame and in close proximity thereto. The connectors are in turn disposed so as to reside between the end portions of the elongated horizontal grate members. Thus, the connectors do not interfere with the positioning of the grate and the desired coplanar relationship of the top surface of the grate riser frame and a grate disposed therein is achieved.

Preferably, the connectors are attached to and depend from inner surfaces of the opposing grate riser frame sections so as to at least substantially engage in the surfaces of the flange carrying sections of the catch basin frame. Thus, the grate riser is maintained in at least one direction in a fixed position horizontally atop the catch basin frame. Further, the elevated support members of the grate riser preferably have outer side surfaces substantially in coplanar relationship With inner surfaces of the corresponding frame sections. Thus, the said surfaces at least substantially engage inner surfaces of the flange carrying section of the catch basin frame and thereby maintain the grate riser frame in fixed position horizontally in at least one other direction atop the said frame. Still further, opposite end surfaces of the elevated grate riser members are preferably arranged substantially in coplanar relationship with inner surfaces of the side sections of the catch basin frame. Thus, the grate riser frame is maintained in a fixed position horizontally in still another direction of possible accidental or incidental movement.

In accordance with the present invention, the aforementioned connectors on one opposing frame section are spaced horizontally a substantially greater distance than those on the other of said opposing sections. Further, connector receiving notches in each support member are dimensioned and spaced horizontally so as to freely receive vertically the connectors associated with the opposite support member. This arrangement provides for efficient stacking of the grate risers as will be described herein below and for accommodation of two or more pavement overlays as mentioned above.

DESCRIPTION OF THE DRAWINGS

FIG. 3 is a perspective view of a grate riser constructed in accordance with the present invention.

FIG. 4 is a vertical section taken generally as indicated in 4, 4 and showing one end portion of the grate riser of the invention.

DESCRIPTION OF THE PREFERRED EMBODIMENT

Figure 1:
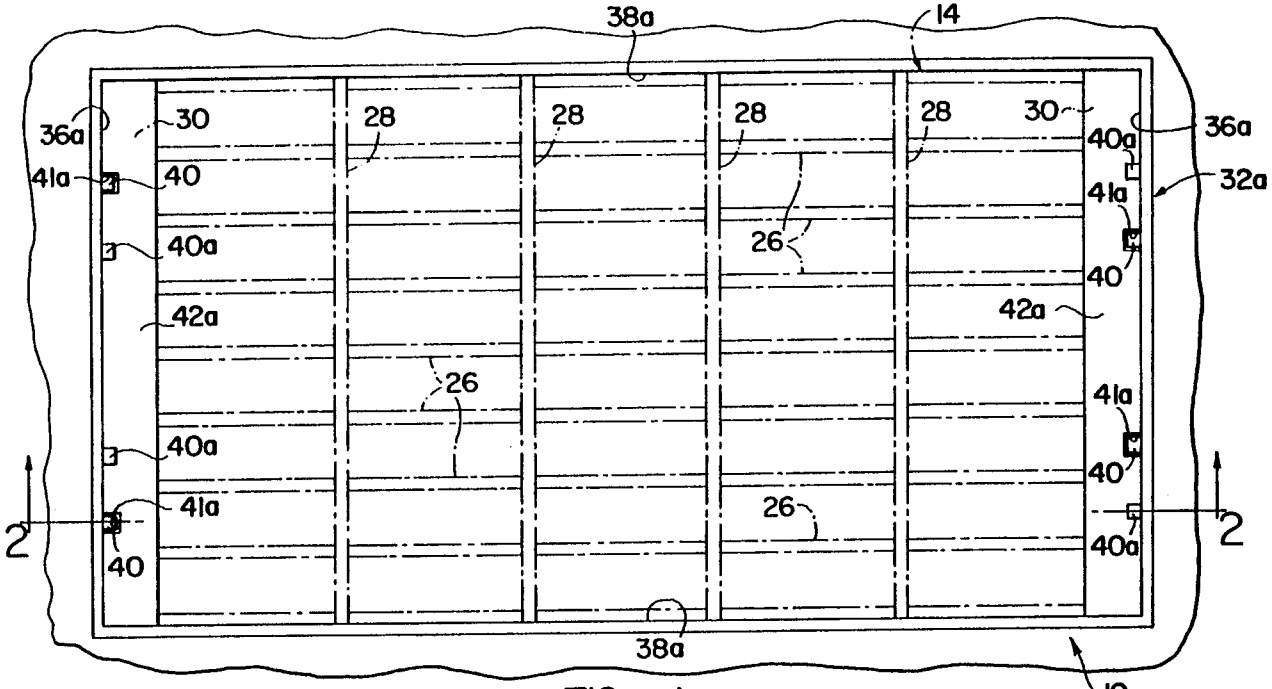
FIG. 1 of the drawings is a top view of a catch basin including a generally rectangular vertically open frame and a cooperating grate having a plurality of parallel spaced apart elongated horizontal grate members, the grate being supported within the frame.
Figure 2:
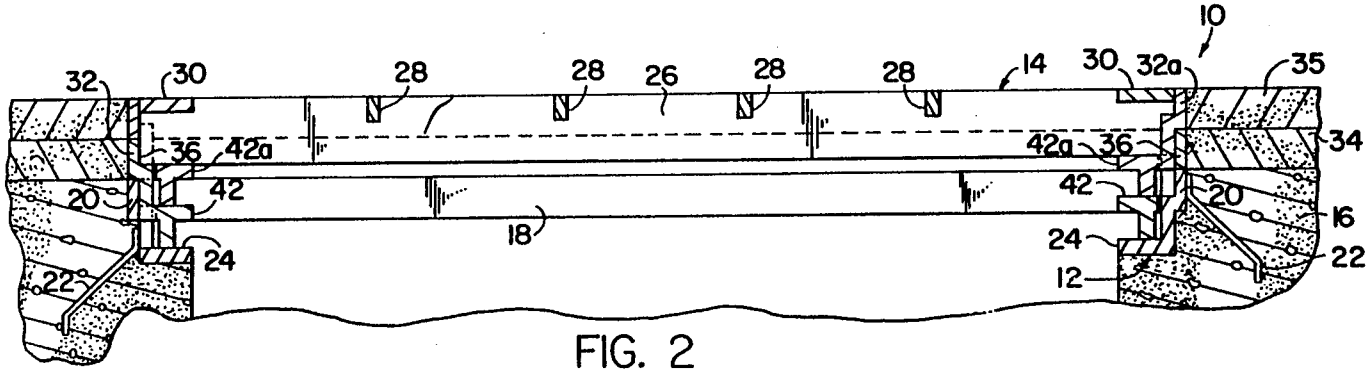
FIG. 2 is a vertical sectional view taken generally at 2, 2 in FIG. 1 and illustrating the frame and grate members in cross section together with a grate riser assembly therebeneath.

Referring particular to FIGS. 1 and 2, a catch basin indicated generally at 10 comprises a frame indicated generally at 12, a grate indicated generally at 14, and a precast concrete member indicated generally at 16 and supporting the frame and grate. The frame 12 is open vertically and takes a generally rectangular configuration with similar opposing side walls or wall sections 18, 18 and similar opposing end walls or wall sections 20, 20. Each of the walls or wall sections comprises a similar narrow flat vertical member and, preferably, all four of the walls or wall sections are formed integrally. The opposing end walls 20, 20 each carry a pair of anchors 22, 22 which extend angularly downwardly and outwardly relative thereto and which are embedded in the precast concrete member 16 associated with the frame. Further, each end wall or end wall frame section 20 carries an inwardly projecting horizontal flange 24. As illustrated, the flanges 24, 24 extend throughout the length of the end walls 20, 20 and are formed integrally therewith and at right angles relative thereto. The flanges 24, 24 serve to support the grate 14 as is more fully described herein below.

Catch basin grates vary widely and the construction and arrangement of the grate 14 should therefore be regarded as an illustrative example only. The grate 14 comprises a plurality of parallel elongated horizontal members which are spaced transversely for the downward passage of water and debris therebetween. Nine, (9) elongated members 26, 26 are shown but the number of such members may of course vary widely. The members 26, 26 are elongated, flat, and preferably narrow vertically and are secured in spaced position by a transversely extending intermediate member 28. Optionally, opposite end transversely extending members 30, 30 may also be provided.

The grate comprising the members 26, 26 and the transverse members 28, 30 may be removed from and deposited within the frame 12 as an integral subassembly. As will be apparent, opposite end portions of the members 26, 26 rest on and are supported by the aforementioned flanges 24, 24 when the grate is in its assembled position in the frame. The grate may be secured in position solely by the force of gravity and may be readily removed and elevated by the grate riser assembly of the present invention as will be described hereinbelow.

The grate riser assembly of the present invention comprises two or more grate risers as illustrated in FIGS. 2, 3 and 4. Each grate riser comprises a vertically open general rectangular frame indicated generally at 32 .and which is coextensive with a catch basin frame with which the grate riser is intended for use. Frame 32 has opposing narrow vertical end and side walls or wall sections 36, 36 and 38, 38 of a height substantially equal to that of the pavement overlay to be accounted as best illustrated in FIG. 2 at 34, 35. Opposing end walls 36, 36 are preferably formed integrally With opposing side walls 38, 38 and the top surfaces of the resulting walls 36, 36 and 38, 38 reside in the plane of the top surface of a first pavement overlay 34 as illustrated in FIG. 2.

At least two horizontally spaced apart connectors are secured to and depend from each of two opposing end wall sections 36, 36 of the grate riser frame as illustrated at 40, 40. The connectors 40, 40 are welded at upper end portions to the frame end walls 36, 36 and depend therefrom as best illustrated in FIGS. 3 and 4. The outer surfaces of the connectors are substantially in the plane of the inner surface of the end walls 36, 36. Thus, engagement or at least substantial engagement is provided for between the outer surfaces of the connectors 40, 40 and the inner surfaces of the end walls 20, 20 of the catch basin frame 12. This results in the horizontal positioning of the grate riser in at least one direction relative to the frame 12. That is, the grate riser frame is thus preferably positioned longitudinally, as shown, relative to the frame 12.

The connectors 40, 40 on one opposing frame section 36, the left hand section of FIG. 3 as illustrated, are spaced horizontally a substantially lesser distance than those on the other frame section, i.e. the right hand frame section in FIG. 3. That is, the right hand connectors are relatively widely spaced apart horizontally while the left hand connectors are relatively narrowly spaced apart horizontally.

The connectors 40, 40 respectively support first and second elevated auxiliary horizontal grate support members 42, 42. That is, the members 42, 42 have horizontal upper supporting surfaces which extend inwardly from the end walls 36, 36 and which support end portions of the grate members 26, 26 in a manner substantially identical with the support of the end portions by the aforementioned catch basin flanges 24, 24. Further, it should be noted that the vertical dimension of the upper connectors 40, 40 is such that the height of the frame sections 36, 36 and 38, 38 may be combined therewith to provide a composite height dimension equal to that of the grate 14. Thus, the grate rests on the flanges 42, 42 with its upper surface substantially in coplanar relationship With the top surface of the frame 32.

The support members 42, 42 also include riser portions 44, 44 associated therewith and preferably formed integrally at a lower surface thereof. That is, the members 42, 44 together take a "T" configuration when viewed in cross section and the depending riser portions or flanges 44, 44 are adapted to rest on the aforementioned grate frame flanges 24, 24 as best illustrated in FIG. 2. The distance measured from the top surfaces of the members 42, 42 to the bottom of the riser portion of the flanges 44, 44 is equal to the aforementioned dimension of the walls 36, 38 of the grate riser 32. As shown, the said dimensions each equal approximately 1½ inches and the cumulative dimension equals approximately 3 inches. In the event of a first pavement overlay 34 requiring a riser in excess of 1½ inches, it is of course possible to design the frame 32 with a different height dimension as may be required for any desired depth of overlay pavement. The dimension of the support member may of course also be similarly varied to provide for the proper elevation from the flanges 24, 24 and for the desired coplanar relationship of the top of the grate with the walls 36, 38 and with the top surface of the pavement overlay.

It should also be observed that the connectors 40, 40 are shown located between the members 26, 26 of the grate so as not to interfere With the same and to allow a nesting relationship thereof with the grate members. It should also be observed that notches 41, 41 are provided in the support members 42, 42 for receiving the connectors 40, 40. The notches are so dimensioned and spaced horizontally as to receive vertically the connectors associated with an opposite support member 42. Thus, notches 41, 41 in the left hand member 42 in FIG. 3 are relatively widely spaced horizontally while the notches 41, 41 in the right hand supporting member 42 are relatively narrowly spaced.

Reverting now to FIG. 2, it will be observed that a second grate riser **32*a* is mounted in stacked relationship atop the first grate riser 32 and is reversed through 180° horizontally so as to cause the notches 41, 41 thereon to receive portions of the connectors of the first grate riser 40, 40 when the second grate riser rests atop the support members 42, 42 of the first grate riser. The grate 14 is disposed within the second grate riser 32*a*, and, more particularly, atop its support members 42*a*, 42*a* so as to provide for the location of its upper surface in precise coplanar coincidence with the upper surface of the second pavement overlay 35**.

It will also be apparent from the foregoing that a third and/or fourth grate riser can be readily provided in the event of additional pavement overlays. Thus, rapid and efficient elevation of catch basin grates can be accomplished. It is only necessary to lift a grate 14 from its FIG. 1 and 2 position, position a single grate riser such as 32 with its flanges 44, 44 atop the flanges 24, 24 for a single pavement overlay. Thereafter, the grate 14 may be repositioned as shown in FIG. 2 and the paving operation will result in the FIG. 2 condition with the new pavement or pavement overlay 34 residing in coplanar relationship with the lowermost riser frame and grate. The time consuming and tedious task formerly associated with raising the grates of catch basins are thus eliminated and a rapid and efficient operation is provided for in advance of a pavement operation.

In the event that a second pavement overlay is required at a later date, the preceding operation may be repeated and the complete grate riser assembly of FIG. 2 will result. The grate 14 will be positioned precisely as required atop the uppermost grate riser for the coplanar relationship of its upper surface with the top surface of the second pavement overlay 35.

I claim:

1. An improved grate riser assembly for use with catch basins and the like during road repaving operations, the catch basins comprising vertically open generally rectangular frames with at least two similar opposing sections having inwardly projecting horizontal grate support flanges which carry opposite end portions of a series of parallel spaced apart elongated members forming a horizontal grate; and the grate riser assembly comprising a first grate riser having a vertically open generally rectangular frame coextensive with a catch basin frame, similar opposing vertical side and end Wall sections of the frame being of a height substantially equal to the thickness of the new road pavement, and the riser frame being adapted to rest atop the catch basin frame with its upper edge substantially in the plane of the upper surface of the new pavement, at least two small horizontally spaced apart connectors secured to and depending from each of two opposing grate riser frame sections, a pair of horizontal grate support members associated respectively with said two opposing grate riser frame sections and supported at lower end portions of the depending connectors on said frame sections, the connectors on one opposing frame section being spaced horizontally a substantially greater distance than those on the other of said opposing frame sections, connector receiving notches in each support member dimensioned and spaced horizontally so as to receive vertically the connectors associated with the opposite support member, and each support member having a depending riser portion adapted to elevate the top surface of the support member a vertical distance substantially equal to the height of the grate riser frame, said support member thus serving to support and vertically position the grate riser when disposed atop the grate support flanges on the catch basin frame, and a second grate riser disposed in stacked relationship atop the aforesaid first grate riser, the second grate riser being reversed through 180° horizontally so as to cause the notches thereon to receive the connectors of the first grate riser with the riser portions of the second grate riser resting atop the grate support members of the first grate riser, and the grate being disposed atop the grate support members of the second grate riser.

2. An improved grate riser assembly for use with catch basins as set forth in claim 1 wherein said connectors are so spaced horizontally as to reside between end portions of the elongated grate members when a grate is disposed atop said support members on said grate riser frame.

3. An improved grate riser assembly for use with catch basins as set froth in claim 1 wherein said connectors are attached and depend from inner surfaces of said opposing grate riser sections and at least substantially engage inner surfaces said flange carrying sections of said catch basin frame so to maintain said grate riser frame in fixed position in at one direction horizontally atop said catch basin.

4. An improved grate riser assembly for use with catch as set froth in claim 1 wherein said elevated horizontal grate support members associated respectively with said two grate riser frame sections have outer surfaces substantially in coplanar relationship with inner surfaces of the corresponding frame sections whereby to at least substantially engage inner surfaces of said flange carrying sections of said catch bas frame so as to maintain said grate riser frame in fixed in at least one direction horizontally atop the catch basin frame.

5. An improved grate riser assembly for use with catch basins as set forth in claim 1 wherein said two horizontally spaced apart connectors comprise small substantially vertically depending members welded to inner surfaces of said opposing grate riser frame sections and having said elevated horizontal grate support members welded to lower portions thereof.

6. An improved grate riser assembly for use with catch basins as set forth in claim 1 wherein said riser portions of said grate support members take the form of depending vertical flanges formed integrally with said support members and resting upon said grate support flanges on said catch basin frame.

7. An improved grate riser assembly for use with catch basins as set forth in claim 6, wherein said depending vertical flanges are formed approximately intermediate the width of the elevated horizontal grate support members to provide therewith substantially a "T" configuration in cross section.

8. An improved grate riser assembly for use with catch basins as set forth in claim 7, wherein the length of said elevated horizontal grate support members and associated depending flanges is such as to result in the engagement of end surfaces thereof with opposing frame sections of an associated catch basin and to thereby restrain the grate riser against horizontal movement in at least one direction relative to the catch basin frame.

* * * * *